US005766418A

United States Patent [19]

Prough

[11] Patent Number: 5,766,418

[45] Date of Patent: Jun. 16, 1998

[54] HANDLING FIBROUS MATERIAL USED TO PRODUCE CELLULOSE PULP

[75] Inventor: J. Robert Prough, Tarpon Springs, Fla.

[73] Assignee: Ahlstrom Machinery Inc., Glens Falls, N.Y.

[21] Appl. No.: 713,431

[22] Filed: Sep. 13, 1996

[51] Int. Cl.[6] ..... D21C 7/06

[52] U.S. Cl. ..... 162/246; 162/232; 162/237

[58] Field of Search ..... 162/246, 232, 162/237, 238, 243, 68, 52, 17; 222/146.4, 153.01

[56] References Cited

U.S. PATENT DOCUMENTS

| | | | |
|---|---|---|---|
| 2,459,180 | 1/1949 | Richter . | |
| 2,474,862 | 7/1949 | Christoffer et al. . | |
| 2,914,223 | 11/1959 | Richter . | |
| 2,960,161 | 11/1960 | Richter . | |
| 3,007,839 | 11/1961 | Richter . | |
| 3,041,233 | 6/1962 | Richter | 162/246 X |
| 3,157,565 | 11/1964 | Gremler | 162/246 X |
| 3,298,899 | 1/1967 | Laakso . | |
| 3,429,773 | 2/1969 | Richter . | |
| 3,532,594 | 10/1970 | Richter . | |
| 3,586,600 | 6/1971 | Rich et al. | 162/246 X |
| 4,096,027 | 6/1978 | Sherman . | |
| 4,124,440 | 11/1978 | Sherman . | |
| 4,927,312 | 5/1990 | Meredith et al. . | |
| 5,500,083 | 3/1996 | Johanson . | |
| 5,547,546 | 8/1996 | Prough et al. . | |

FOREIGN PATENT DOCUMENTS

| | | |
|---|---|---|
| 1 146 788 | 5/1983 | Canada . |
| 1 154 622 | 10/1983 | Canada . |

*Primary Examiner*—Donald E. Czaja
*Assistant Examiner*—Jose A. Fortuna
*Attorney, Agent, or Firm*—Nixon & Vanderhye P.C.

[57] ABSTRACT

Untreated wood chips are fed to treatment, e.g. steaming at substantially atmospheric pressure, using a mechanical conveyor. Steaming may be accomplished utilizing a vertical chip bin with one dimensional convergence and side relief fed by a horizontal conveyor (e.g. screw conveyor) having a physical restriction which insures formation of a chip plug to prevent leakage of gas through the conveyor housing inlet. The physical restriction may be a generally vertical hinged plate, with an opening containing elastomeric material through which the shaft of the conveyor may pass, or a stationary generally vertical plate with one or more openings, which openings also may be covered with yielding flexible material and with the degree of sealing provided controlled by the speed of rotation of the conveyor shaft.

14 Claims, 2 Drawing Sheets

HANDLING FIBROUS MATERIAL USED TO PRODUCE CELLULOSE PULP

In the chemical pulping of fibrous, cellulosic material for producing paper and board, the raw material is treated with chemicals, for example, sodium and sulfur compounds, at elevated temperature. Typically, this treatment is performed at superatmospheric pressure to ensure that the aqueous solutions remain in liquid form. The chemicals react with the organic and non-organic constituents of the raw material such that some of the organic and non-organic constituents are dissolved to yield a product consisting of cellulose fibers in an aqueous slurry of dissolved reaction products. The slurry is typically cleaned and dewatered to provide an essentially pure form of cellulose fibers for paper making.

In order to provide a cost effective method of chemical pulping, the pulp and paper maker is interested in a process that utilizes the least energy, the least cooking chemicals and produces a pulp that, if desired, is easily bleached (that is, the pulp consumes a minimum amount of bleaching chemical) and has the strongest strength properties. The stronger the pulp, the more strain it can withstand on the paper machine and the faster the paper machine can be run.

One of the most significant requirements of chemical pulping is that the comminuted cellulosic fibrous material be properly steamed prior to the introduction of cooking chemicals. The comminuted cellulosic fibrous material, for example, softwood chips, entering the pulping process typically contain significant volumes of air. This air hinders the penetration of cooking chemicals into the chips. In order to effectively penetrate the chips with cooking liquor this air must be removed. Furthermore, the evacuation of air from the chips is necessary to ensure hat the chips sink during the pulping process and do not tend to float.

This evacuation of air is initiated in the steaming process. The chips, or other comminuted cellulosic fibrous materials, are exposed to steam in a controlled fashion such that the air is displaced with steam which condenses within the chips. Upon exposure to cooking chemicals the condensate-saturated chip more readily absorbs and retains the cooking chemical than if pockets of air were present. This ideal uniform absorption of cooking chemical promotes uniform treatment of the chip—requiring less energy and less cooking chemicals—and a stronger, more uniform pulp product results.

Typically for conventional continuous pulping systems the steaming process is initiated in cylindrical vessels, or chip bins, having agitators on the bottom to agitate the chip column and ensure a continuous discharge of chips. Typically steam is added to these atmospheric vessels to initiate the steaming process. However, due to the restrictive geometry of these vessels and due to the agitation, the movement of the chips within the vessel is typically non-uniform. As a result the exposure to steam and the retention time in these vessels is also typically non-uniform. Due to this non-uniformity of steaming in such vessels, these vessels are typically followed by a pressurized steaming vessels, for example, horizontal steaming vessels having a screw conveyor. This pressurized pretreatment improves the effectiveness of the steaming process but also inherently increases the temperature of the chips.

After this steam treatment, cooking liquor is conventionally introduced to the chips to produce a heated slurry of chips and liquor. This slurry is then typically transported via a high pressure transfer device, for example a High-pressure feeder sold by Ahlstrom Machinery, to a cooking vessel, that is, a digester or impregnation vessel. During this transfer, the chips are typically further heated by exposure to hotter cooking liquors. The temperature of the slurry is raised further to cooking temperature (140°–180° C.) prior to or in the digester.

U.S. Pat. No. 5,500,083 discloses a novel apparatus and method for steaming comminuted cellulosic fibrous material. This apparatus, sold under the trademark DIAMONDBACK® by Ahlstrom Machinery of Glens Falls, N.Y., employs a bin geometry having single (one dimensional)-convergence with side-relief, that permits dramatically improved treatment of the chips. In addition to eliminating the need for agitation in the outlet of a vertical steaming vessel, the DIAMONDBACK® steaming vessel dramatically improves the uniformity with which chips are exposed to steam. For example, where the conventional steaming of chips under atmospheric conditions in a cylindrical bin with vibratory discharge requires a separate pressurized steaming, for example, in a horizontal, screw-type steaming vessel, the DIAMONDBACK® vessel uniformly exposes the chips to steam under atmospheric conditions such that no pressurized steaming, and the pressure vessel required, are necessary. This uniform steaming time is only presently achievable in a DIAMONDBACK® steaming vessel. In order to achieve the quality of steaming possible in a DIAMONDBACK® steaming vessel in conventional systems much longer exposure times, that is longer retention times, are required. Such prolonged exposure to steam in conventional equipment only results in non-uniform treatment and wasted energy. Furthermore, since the steaming of the chips is so much more uniform and effective in a DIAMONDBACK® bin, the steaming process need not be pressurized. This has the further benefit that the chips are not prematurely exposed to elevated steam temperatures, that is, due to steaming with superheated steam, prior to the formal pulping process. Thus the DIAMONDBACK® bin now permits the treatment of the chips at lower temperatures prior to formal cooking that heretofore was not possible.

According to the invention, a screw feeder is used to introduce untreated wood chips (or other comminuted cellulosic fibrous material) into a feeding system, such as a steaming vessel (e.g. a DIAMONDBACK® chip bin). The use of screw conveyors in the feed systems of digesters, per se, is not new. In the very first systems proposed and tested by Richter et al some form of screw conveyor was present. For example, FIGS. 2–8 of Richter's *The History of Kamyr Continuous Cooking* illustrates various screw-type conveyors that were used. Also, U.S. Pat. Nos. 2,474,862; 2,459,180; 2,914,223; 2,960,161; 3,007,839; 3,298,899 and various other U.S. patents illustrate typical screw-type conveyors for transferring chip slurries in the feed system of a digester. In particular, U.S. Pat. Nos. 3,429,773 and 3,532,594, among others, illustrate the so-called "Mumin" inclined screw feeder for feeding chips to digesters, in particular to vapor-phase digesters. A vertically-oriented screw feeder, known in the art as a "top separator", is commonly used to introduce chips to a digester. However, all of these prior art screw feeders were used to feed chips that had already received some form of thermal or chemical treatment, for example, steaming or slurrying with a cooking liquor. None of the above-described devices was used as a means of introducing the untreated chips to the feeding system.

The advent of atmospheric pre-steaming of wood chips in the 1970s provided for the introduction of steam to the chip storage vessel, that is "chip bins", to initiate the heating of the chips and to evacuate air from the chips prior to subsequent pressurized steaming of the chips. It has also been known per se to use screw conveyors to transport chips to a chip bin inlet. However these screw conveyors have no effective sealing capability and sulfurous gases pass through them to atmosphere causing an undesirable air pollution problem. Some of the other means for introducing and controlling the steaming of the chip mass are disclosed in U.S. Pat. No. 4,124,440 and Canadian patents 1,154,622 and 1,146,788. Typically, to prevent the discharge of steam and to control the gas pressure within such bins some form of pressure isolation or "air lock" device was used to introduce untreated chips to the chip bins, and to minimize leakage of sulfurous gases. Such devices, known as "chip meters" as shown in the above two Canadian patents, are typically still used to meter the flow of incoming chips and minimize the discharge of gases from the bin. These chip meters are also typically supplemented by "chip gates" as disclosed in U.S. Pat. No. 4,927,312 to further prevent the escape of gases and control pressure.

Another device proposed to limit the escape of gases from the chip bin is disclosed in U.S. Pat. No. 4,096,027. This patent discloses an inclined screw conveyor having a partial screw flight which transfers chips from a chip hopper to the inlet of a chip bin to which steam is added. The partial flight of the inclined conveyor ideally creates an air-tight seal between the chips being fed and the housing of the screw. However, the device disclosed in U.S. Pat. No. 4,096,027 did not operate as intended. For example, the inclined screw did not effectively transfer the untreated chips to the chip bin unless the screw was operated at undesirably high rotation. Without such high rotation speed, the chips would tend to simply roll back down the screw housing. However, at such high rotational speeds the conveyor operation could not be maintained without undue attention and maintenance. As a result, the use of the device illustrated in U.S. Pat. No. 4,096,027 was abandoned as unfeasible for the desired operation.

The present invention avoids the limitation of the prior art conveying and sealing means by introducing a simple yet effective means for sealing the discharge of a screw conveyor such that the release of gases is minimized and the pressure in the receiving chip bin is maintained at a relatively constant level. This constant pressure in the bin also minimizes the variation in the gas flow to the gas emission collection system known as the Non-condensable Gas (or NCG) system.

According to one aspect of the present invention a comminuted cellulosic fibrous material steaming assembly is provided which has broad applicability of use, but is especially desirable for use with low temperature steaming and slurrying. An exemplary assembly according to the present invention comprises the following components: A substantially vertically oriented chip bin with steam introduction having a top, a bottom, an inlet adjacent the top, and an outlet adjacent the bottom. And a conveying vessel for conveying comminuted cellulose material and feeding the material to the chip bin inlet, the conveying vessel comprising: a substantially tubular housing having opposite first and second ends, an inlet adjacent the first end, and a downwardly extending outlet adjacent the second end; a conveyor in the housing for conveying comminuted cellulose material from the first end to the second end; and sealing means at the second end adjacent the outlet for providing a substantially gas tight seal between the housing and the material being conveyed so that gas from the chip bin will not leak to an environment surrounding the conveying vessel through the housing to the housing inlet, the sealing means comprising means for providing a physical restriction adjacent the housing outlet.

The sealing means that physically restricts the material flow may comprise a metal normally substantially vertical hinged plate, or a metal substantially vertically elongated stationary plate. Where a hinged plate is utilized, the hinged plate has an opening and the conveyor includes a shaft extending from the first end toward the second end, the shaft extending through the opening in the hinged plate. A flexible material seal (e.g. of rubber or other elastomeric material) can be provided between the shaft and the hinged plate in the opening; e.g. a pair of overlapping elastic material flaps may be provided. The opening in the hinged plate is preferably in the form of a cutout, being open at the bottom thereof with the hinged plate being substantially vertical and the hinged plate opening includes an upper portion which pivots along the curved path. A baffle, such as a pipe elbow, may be disposed above the shaft and disposed along the curved path to provide a minimal clearance with the plate so that leakage of gas through the upper portion of the plate opening is minimized.

The plate typically includes a top and a bottom, and has an exterior surface substantially corresponding to the interior of the housing thereat, and hinged so that when in a vertical position the plate is immediately adjacent a portion of the housing outlet nearest the housing inlet. The plate may be hinged adjacent the top thereof, or at a middle portion thereof, or under some circumstances closer to the bottom. Means also may be provided for biasing the plate to the substantially vertical position. The biasing means may comprise at least one spring (such as a torsion spring or a block of elastomeric material), counterweight, fluid piston cylinder assemblies (e.g. hydraulic and pneumatic), combinations thereof, or any other suitable conventional biasing structures for biasing a plate to a particular position.

Where the sealing means physical restriction includes a substantially vertical or stationary plate, having a top and a bottom, the plate exterior surface substantially corresponds to the interior of the housing whereat it typically occupies at least about 50% of the interior cross section of the housing where the plate is located (and the same is true for the hinged plate when in the substantially vertical position). The stationary plate may be positioned immediately adjacent a portion of the housing outlet nearest the housing inlet, and an opening is provided in the plate through which the cellulose material is fed by the conveyor from the inlet to the outlet. The opening in the plate may be closed by a flexible material (e.g. the overlapping flaps of rubber or like as described above with respect to the movable plate where the opening has a cutout shape, or the opening may be circular where a plurality of inwardly radially extending flaps extend into the opening). The sealing means may further comprise a variable speed motor controlling rotation of the shaft and a controller for controlling the speed of operation of the motor. The degree of sealing provided by the material at the plate is then controlled by the speed of rotation of the shaft.

In all embodiments the conveyor preferably includes at least one screw flight connected to the shaft, and the chip bin preferably comprises a chip bin having one dimensional convergence and side relief (i.e. a DIAMONDBACK® bin). Also, the screw flight may not extend to the outlet of the conveyor but may stop short of the outlet to ensure that the tubular housing of the conveyor nearest the outlet runs full of material to further minimize the passage gases.

As an alternative to the above constructions, the physical restriction may be either a hinged (biased to a generally horizontal position) or stationary (generally horizontally extending) plate disposed in the vertical outlet from the conveyor housing to the chip bin, with one or more openings (with or without flexible material) in the plate through which the material flows, or in an opening defined between the plate and the wall of the conduit through which the material flows past the plate.

According to another aspect of the present invention, a method of handling chemically or thermally untreated comminuted cellulosic fibrous material using a screw conveyor having an inlet and an outlet, and a treatment device having an inlet is provided. The method comprises the steps of substantially continuously: (a) With the screw conveyor, conveying the untreated comminuted cellulosic fibrous material in a first direction from the screw conveyor inlet, and discharging the material from the screw conveyor outlet to the treatment device inlet. (b) While substantially continuously operating the screw conveyor, providing a substantially gas tight seal by causing a material plug to form using a physical restriction adjacent to where the material is discharged from the conveyor to the treatment device so that gas (particularly sulfurous gas) from the treatment device will not leak to an environment surrounding the screw conveyor, or through the screw conveyor to the screw conveyor inlet; and (c) treating the material in the treatment device. The first direction is preferably substantially horizontal (i.e. within about ten degrees or less from exactly horizontal, preferably less than five degrees from exactly horizontal). Step (b) is preferably practiced by providing as the physical restriction a pivoted gate, which does not interfere with operation of the screw conveyor, or a similar structure, adjacent a discharge from the screw conveyor outlet to the treatment device inlet. Step (c) is preferably practiced by steaming in the treatment device at substantially atmospheric pressure, the passage through the conveyor of vapors and other gases as a result of steaming being precluded by the physical seal.

The method is particularly useful for introducing material into a chip bin (typically one in which steaming takes place) in such a way that there is substantially no (i.e. minimal) leakage of sulfurous gases through the introducing device (e.g. screw conveyor).

According to another aspect of the present invention, another method of handling untreated comminuted cellulosic fibrous material using a mechanical conveyor having an inlet and an outlet, and steaming device having an inlet, is provided. The method comprises the steps of substantially continuously: (a) With the mechanical conveyor, conveying the untreated comminuted cellulosic fibrous material in a substantially horizontal first direction from the conveyor inlet, and discharging the material from the conveyor outlet to the steaming device inlet. (b) While substantially continuously operating the mechanical conveyor, providing a substantially gas tight seal by causing a material plug to form with a physical restriction adjacent to where the material is discharged from the conveyor to the treatment device, so that gas (particularly sulfurous gas) from the steaming device will not leak to an environment surrounding the conveyor, or through the conveyor to the conveyor inlet; and (c) steaming the material in the treatment device at substantially atmospheric pressure (i.e. between 0.9–1.2 bar absolute, preferably about 1 bar absolute).

The objects of the invention will become clear from an inspection of the detailed description of the invention and from the appended claims.

DETAILED DESCRIPTION OF THE DRAWINGS

Figure 1:
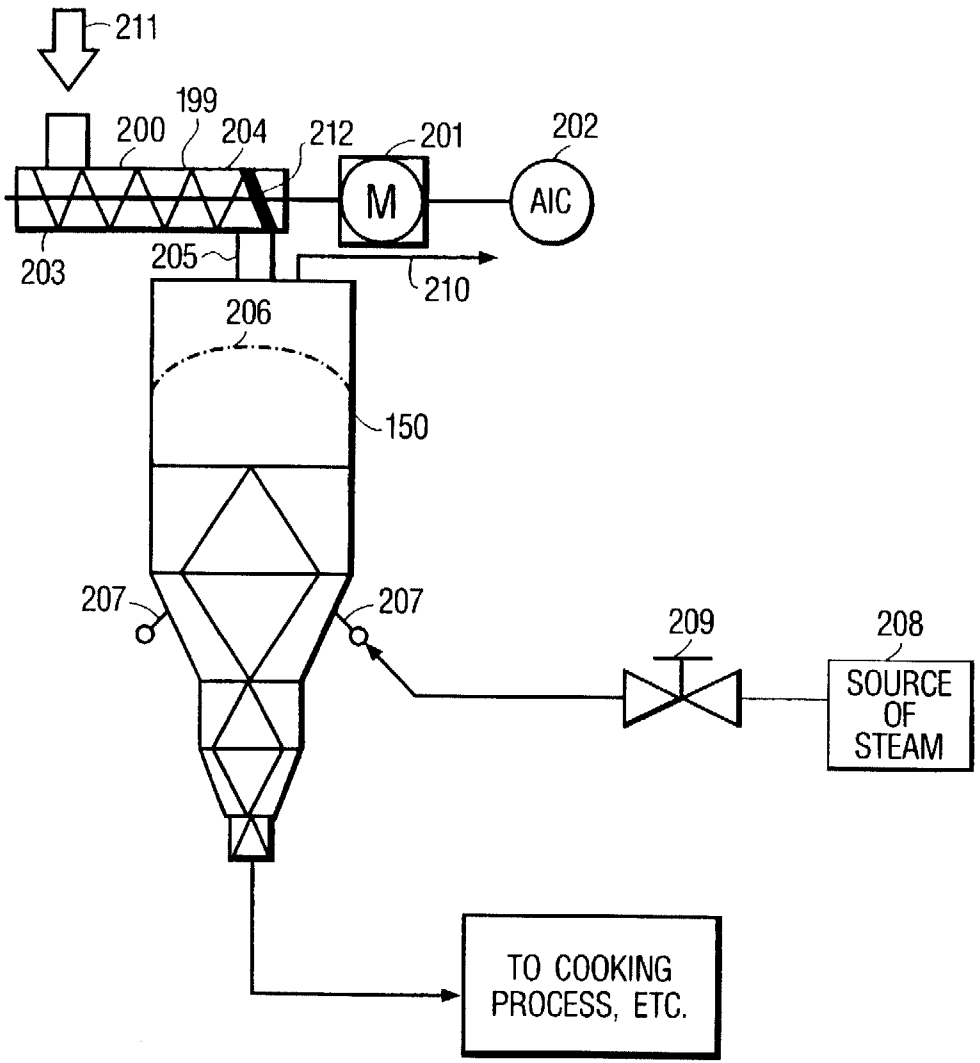
FIG. 1 is a schematic side view of a chip bin having one dimensional convergence and side relief for steaming chips with a novel conveyor for feeding chips to the chip bin.

A preferred embodiment of a complete system according to the invention is shown schematically in FIG. 1. In FIG. 1 the vertical vessel 150 is a DIAMONDBACK® chip bin as disclosed in U.S. Pat. No. 5,500,083 (the disclosure of which is incorporated by reference herein). The vessel 150 is fed by means of a horizontal screw conveyor 200, which is driven by electric motor 201, having a housing 199. The motor 201 may be a variable speed motor which is controlled by controller 202. The conveyor 200 has an inlet end 203 for receiving comminuted cellulosic fibrous material, 211, for example softwood chips, and a discharge end 204 for discharging material to vessel 150 via outlet conduit 205. The material is fed such that a level of material, 206, is maintained in vessel 150 and monitored by a level indicator (not shown), for example, a source and detector of radiation. Vessel 150 also typically and detector of radiation. Vessel 150 also typically includes a vent 210 for venting gases to the non-condensable gas (NCG) system.

Steam is added to vessel 150 by means of one or more inlets distributed around the vessel 150 and fed by a source of steam 208, for example, via one or more control valves 209. According to the invention, the steaming in vessel 150 is preferably performed at substantially atmospheric conditions (i.e. between 0.9–1.2 bar absolute, preferably about 1 bar absolute) such that the steamed material exiting vessel 150 is at approximately 100° C. (212° F.) or less, although higher steaming temperatures may be used. The steamed material is discharged from the outlet of vessel 150 without agitation or vibration, preferably, by passing it through one or more outlet transitions having a geometry with single-convergence and side-relief. From vessel 150 the material is directed to a conventional steaming vessel, or a conventional slurry pump, or directly to a conventional high-pressure transfer device for example, a HPF as sold by Ahlstrom Machinery. The material discharged from vessel 150 may also be directed to a metering device, for example, a chip meter of metering screw, or to a pressure-isolation device, for example, a star-type feeder (e.g. a low pressure feeder) or another conveyor 200.

While the vessel 150 is the preferred steaming vessel, conventional chip bins (as in U.S. Pat. No. 4,096,027 or Canadian 1,146,788 or 1,154,622) or other steaming vessels (e.g. conventional horizontal steaming vessels) may be used.

Figure 2:
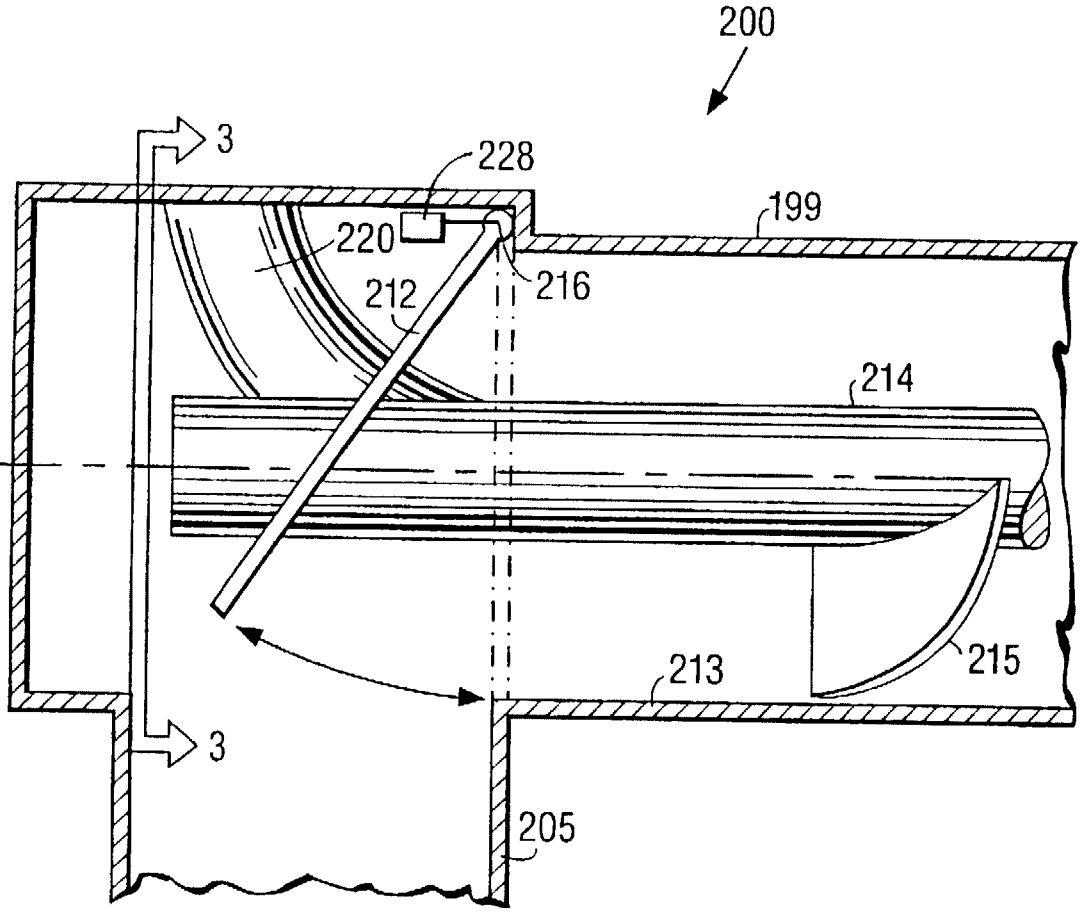
FIG. 2 is a side view, partly in cross section and partly in elevation, of the outlet end of a conveyor housing like the conveyor housing illustrated in FIG. 1.
Figure 3:
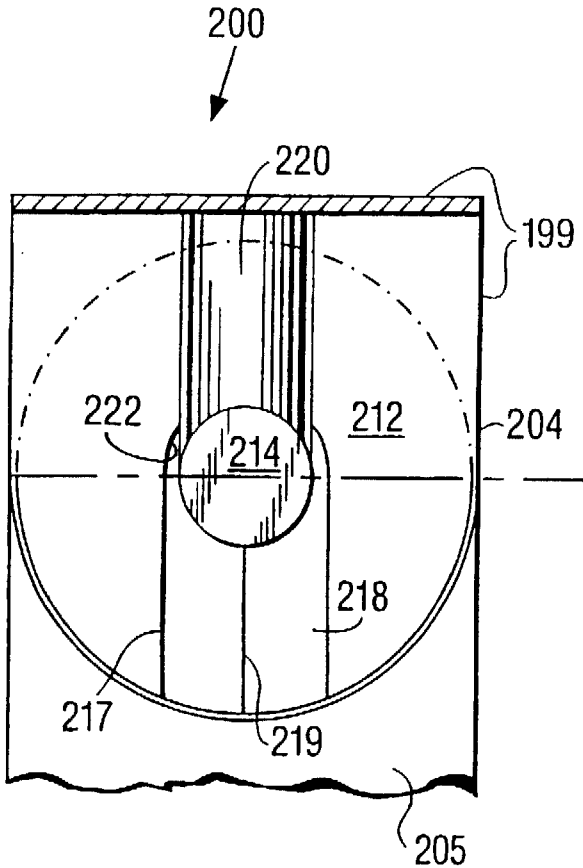
FIG. 3 is an end cross sectional view taken along lines 3—3 of FIG. 2.

In the preferred embodiment of this invention, the conveyor 200 includes a restriction 212 at its outlet end 204 such that an essentially gas-tight seal is produced between the material being conveyed and the conveyor housing. A detail of this sealing arrangement is shown in FIGS. 2 and 3. This seal is shown in relation to a horizontal screw-type conveyor, but any form of similar conventional mechanical conveyor can be modified to accommodate this sealing arrangement.

FIGS. 2 and 3 provide an illustration of the discharge end 204 of conveyor 200. FIG. 2 shows a horizontal, elevation view of the outlet end 204. FIG. 3 shows an axial view of the outlet end along section 3—3 of FIG. 2. In FIG. 3 the restriction plate 212 is shown in the completely closed position for clarity.

The screw conveyor 200 comprises a housing having an internal surface 213, a drive shaft 214, and one or more conventional screw flights 215. The shaft 214 is so driven that the material (not shown), for example, softwood chips, is conveyed by the screw flights 215 and discharged to conduit 205. According to this embodiment of the invention, the flow of material into conduit 205 is restricted by plate 212 which is hinged at one end 216 to the conveyor 200 housing. In order to minimize the escape of gases from vessel 150, via conduit 205, the flow of material out of conveyor 200 is restricted so that a plug of material accumulates in the outlet end 204 producing a gas-tight seal between the material being transferred and the inner surface of the housing 213 as a result of physical seal provided by the plate 212, or a like physical restriction.

Though it is preferred that the shaft 214 will not extend past the end of the conveyor 200 housing and not interfere with the deflection and sealing means, the shaft 214 may extend past the outlet of the screw either to engage a roller bearing or a power source (as in FIG. 1). When this is so, the plate 212 will include an aperture (e.g. open bottom channel or cutout) 217 (FIG. 3) so that when the plate 212 deflects it does not interfere with the shaft 214. The aperture 217 is preferably equipped with a means for sealing the aperture 217, for example, a flexible barrier 218 (e.g. of rubber or other elastomeric material such as a pair of overlapping flaps, or a single sheet with a slit 219) that permits the barrier to separate upon deflection of the plate, 212. The barrier 218, for example, a sheet or flap of elastomeric material, can minimize the escape of gases between the shaft 214 and the plate aperture 217 as the plate 212 pivots. Furthermore, to minimize the escape of gases as the plate 212 pivots, a stationary baffle 220 is preferably positioned above the shaft 214 such that as the plate 212 deflects a minimum clearance is maintained between the upper portion 222 of the plate aperture 217 and the baffle 220. The baffle 220 may comprise a pipe elbow fixed to the conveyor housing 200 and fashioned so that it does not interfere with the rotation of the shaft 214.

The plate 212 is typically biased (linearly or non-linearly, having a curve corresponding to the path of movement of the portion 222 when plate 212 pivots) into a vertical position, as shown in phantom in FIG. 2, by means of a spring, counter-weight, or some other form of mechanical, hydraulic, or pneumatic means (e.g. pneumatic or hydraulic piston and cylinder assemblies), or combinations thereof. This biasing means is shown only schematically at 228 in FIG. 2. The restriction force may be varied by varying the biasing force depending upon the material being conveyed and the extent of sealing desired. The plate 212 may also be fixed in position and the extent of sealing varied by the load supplied by the power supply. For example, the amps supplied by electric motor 201, see FIG. 1, can be varied by means of controller 202 based upon a pressure or temperature sensor (not shown) located upstream of the seal.

Though the restriction plate 212 is shown hinged at an upper edge, it is understood that the plate 212 could be hinged at the lower edge or at one of the side edges (at or near the middle). It is also understood that the restriction 212 need not be located on the outlet 204 of the conveyor 200 but may also be located as a horizontal gate at the inlet of conduit 205. This restriction and sealing arrangement may also be effected by a set of synchronized gates, e.g. as in U.S. Pat. No. 4,927,312. The plate 212 is preferably substantially flat, but may be curved.

A method of handling untreated comminuted cellulosic fibrous material (211) using the screw conveyor 200 having an inlet (at inlet end 203) and an outlet (at discharge end 204), and a treatment device (e.g. a steaming chip bin 150) having an inlet (adjacent 205) is also provided. The method comprises the steps of substantially continuously: (a) With the screw 215 of the screw conveyor 200, conveying the untreated comminuted cellulosic fibrous material 211 in a first direction (along the shaft axis 214, which is substantially horizontal, i.e. within about ten degrees or less from exactly horizontal, preferably less than five degrees from exactly horizontal) from the screw conveyor inlet (203), and discharging the material from the screw conveyor outlet (204) to the treatment device inlet (205). (b) While substantially continuously operating the screw conveyor 200, providing a substantially gas tight seal by causing a conveyed material (wood chips) plug to form (e.g. using a physical restriction, such as pivoted plate 212, which does not interfere with operation of the screw conveyor) adjacent to where the material is discharged from the conveyor to the treatment device so that gas from the treatment device will not leak to an environment surrounding the screw conveyor, or through the screw conveyor to the screw conveyor inlet. And (c) treating the material in the treatment device, such as steaming the material in the chip bin 150 at substantially atmospheric pressure (i.e. between 0.9–1.2 bar absolute, preferably about 1 bar absolute).

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent systems and devices.

What is claimed is:

1. A comminuted cellulose fibrous material steaming assembly comprising:

a treatment vessel having an inlet and an outlet; and a conveying vessel operatively connected to said treatment vessel for conveying comminuted cellulose material and feeding the material to said treatment vessel inlet, said conveying vessel comprising:

a substantially tubular housing having opposite first and second ends, an inlet adjacent said first end, and a downwardly extending outlet adjacent said second end;

a conveyor in said housing for conveying comminuted cellulose material from said first end to said second end; and sealing means at said second end adjacent said outlet for providing a substantially gas tight seal between said housing and the material being conveyed so that gas from said treatment vessel will not leak to an environment surrounding said conveying vessel through said housing to said housing inlet, said sealing means comprising means for providing a physical restriction for conveyed comminuted cellulose material adjacent said housing outlet, to provide a substantially gas tight seal while allowing the cellulose material to be conveyed through said outlet.

2. An assembly as recited in claim 1 wherein said treatment vessel comprises a chip bin having one dimensional convergence and side relief, a top inlet, and a bottom outlet.

3. An assembly as recited in claim 1 wherein said sealing means physical restriction comprises a hinged plate.

4. An assembly as recited in claim 3 wherein said hinged plate is substantially vertical and has an opening; and wherein said conveyor includes a rotatable shaft extending from said first end toward said second end; and wherein said shaft extends through said opening in said hinged plate, a flexible material seal provided between said shaft and said hinged plate at said opening.

5. An assembly as recited in claim 4 wherein said opening in said hinged plate includes an upper portion which pivots along a curved path, and further comprising a baffle disposed above said shaft and disposed along said curved path to provide a minimal clearance with said plate so that leakage of gas through said upper portion of said plate opening is minimized.

6. An assembly as recited in claim 5 wherein said baffle is a pipe elbow.

7. An assembly as recited in claim 3 wherein said plate is substantially vertically oriented, having a top and a bottom, and having an exterior surface substantially corresponding to the interior of said housing thereat, and hinged so that when in a vertical position said plate is immediately adjacent a portion of said housing outlet nearest said housing inlet.

8. An assembly as recited in claim 7 wherein said plate is hinged adjacent said top thereof.

9. An assembly as recited in claim 7 further comprising means for biasing said plate to said substantially vertical position.

10. An assembly as recited in claim 9 wherein said biasing means comprise at least one spring, counterweight, fluid piston or cylinder assemblies, or combinations thereof.

11. An assembly as recited in claim 1 wherein said sealing means physical restriction includes a substantially vertically oriented stationary plate having a top and a bottom, and having an exterior surface substantially corresponding to the interior of said housing thereat and positioned immediately adjacent a portion of said housing outlet nearest said housing inlet, an opening being provided in said plate through which cellulose material is fed by said conveyor from said inlet to said outlet.

12. An assembly as recited in claim 11 wherein said opening in said plate is closed by a flexible material which may be deformed by cellulose material moving therethrough.

13. An assembly as recited in claim 11 wherein said conveyor includes a rotatable shaft, and wherein said conveyor and sealing means further comprises a variable speed motor operatively connected to said shaft for controlling rotation of said shaft, and a controller operatively connected to said motor for controlling the speed of operation of said motor, the degree of sealing provided by comminuted cellulose material at said plate controlled by the speed of rotation of said shaft.

14. An assembly as recited in claim 13 wherein said conveyor includes at least one screw flight connected to said shaft, and wherein said plate aside from said opening therein occupies at least about 50% of the interior cross section of said housing where said plate is located.

* * * * *